US010266978B2

(12) United States Patent
Alexander et al.

(10) Patent No.: US 10,266,978 B2
(45) Date of Patent: Apr. 23, 2019

(54) LAUNDRY TREATING APPLIANCE

(71) Applicant: Whirlpool Corporation, Benton Harbor, MI (US)

(72) Inventors: Benjamin E. Alexander, Stevensville, MI (US); Michael K. Cluskey, West Lafayette, IN (US); John M. Hunnell, Saint Joseph, MI (US); Christopher A. Jones, Saint Joseph, MI (US); Brenner M. Sharp, Bridgman, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 527 days.

(21) Appl. No.: 14/812,193

(22) Filed: Jul. 29, 2015

(65) Prior Publication Data

US 2017/0029999 A1 Feb. 2, 2017

(51) Int. Cl.

| | |
|---|---|
| ***D06F 17/08*** | (2006.01) |
| ***D06F 37/24*** | (2006.01) |
| *D06F 33/02* | (2006.01) |

(52) U.S. Cl.

CPC ..... *D06F 17/08* (2013.01); *D06F 37/245* (2013.01); *D06F 33/02* (2013.01); *D06F 2222/00* (2013.01)

(58) Field of Classification Search

CPC ..... D06F 17/08; D06F 37/245; D06F 33/02; D06F 2222/00

USPC ..... 68/133

See application file for complete search history.

(56) References Cited

U.S. PATENT DOCUMENTS

| | | | | | |
|---|---|---|---|---|---|
| 2,525,781 | A | * | 10/1950 | De Remer | F16F 15/366 210/363 |
| 3,060,713 | A | * | 10/1962 | Burkall | D06F 37/225 210/144 |
| 3,462,198 | A | | 8/1969 | Onufer | |
| 5,735,006 | A | | 4/1998 | Vande Haar | |
| 5,746,069 | A | * | 5/1998 | Kim | D06F 37/245 68/23.2 |
| 5,782,110 | A | * | 7/1998 | Kim | D06F 37/245 210/144 |
| 5,806,349 | A | | 9/1998 | Kim et al. | |
| 5,857,360 | A | * | 1/1999 | Kim | D06F 37/245 68/23.2 |
| 6,082,151 | A | * | 7/2000 | Wierzba | D06F 37/245 68/23.2 |
| 2014/0069148 | A1 | | 3/2014 | Ohyagi | |

* cited by examiner

*Primary Examiner* — Michael E Barr
*Assistant Examiner* — Tinsae B Ayalew
(74) *Attorney, Agent, or Firm* — McGarry Bair PC

(57) ABSTRACT

A laundry treating appliance includes a rotatable basket defining a treating chamber for receiving a load of laundry items for treatment, and two annular balance rings coupled with the basket for rotation therewith. Each balance ring includes a sump for holding balancing fluid when the rotational speed of the basket is below a critical speed.

18 Claims, 7 Drawing Sheets

LAUNDRY TREATING APPLIANCE

BACKGROUND

Laundry treating appliances, such as washing machines, clothes dryers, refreshers, and non-aqueous systems, may have a configuration based on a rotating basket that defines a treating chamber in which laundry items are placed for treating. In a vertical axis washing machine having a basket and a tub, both the basket and tub typically have an upper opening at their respective upper ends. A balance ring can be coupled with the upper end of the basket to counterbalance a load imbalance that may occur within the treating chamber during a cycle of operation.

BRIEF SUMMARY

A laundry treating appliance for treating laundry according to a cycle of operation includes a rotatable basket configured to rotate about an axis of rotation and defining a treating chamber receiving a load of laundry items for treatment, and two annular balance rings coupled with the basket for rotation therewith, each balance ring having a hollow annular chamber and a fluid partly filling the hollow annular chamber. Each balance ring has a sump in the hollow annular chamber disposed on opposing sides of the axis of rotation such that the fluid will tend to pool in the sumps when the rotational speed of the basket is below a critical speed.

DETAILED DESCRIPTION

Figure 1:
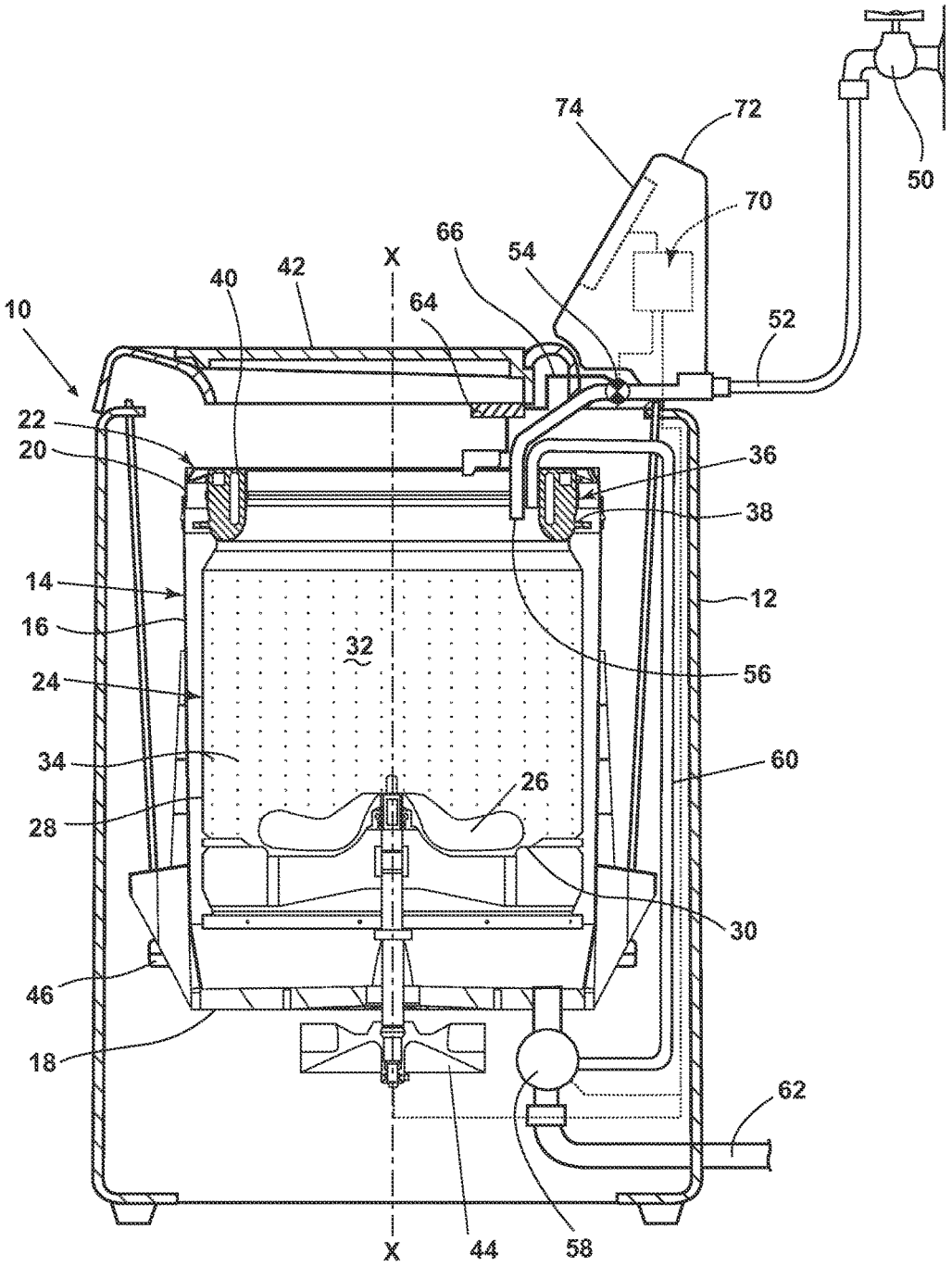
FIG. 1 is a schematic sectional view of a laundry treating appliance in the form of a washing machine according to a first embodiment of the invention.

FIG. 1 is a schematic sectional view of a laundry treating appliance 10 in the form of a washing machine according to one embodiment of the invention. While the laundry treating appliance is illustrated as a vertical axis, top-fill washing machine, the embodiments of the invention may have applicability in other laundry treating appliances, non-limiting examples of which include a combination washing machine and dryer, a refreshing/revitalizing machine, an extractor, or a non-aqueous washing apparatus.

The washing machine 10 may include a structural support system comprising a cabinet 12 that defines a housing within which a laundry holding system resides. The cabinet 12 may be a housing having a chassis and/or a frame, defining an interior that receives components typically found in a conventional washing machine, such as motors, pumps, fluid lines, controls, sensors, transducers, and the like. Such components will not be described further herein except as necessary for a complete understanding of the invention.

The laundry holding system of the illustrated exemplary washing machine 10 may include a water-tight tub 14 installed in the cabinet 12. The tub 14 may have a generally cylindrical side or peripheral wall 16 closed at its bottom end by a base 18 that may at least partially define a sump. An upper edge 20 of the peripheral wall 16 may define an opening to an interior of the tub 14 for holding liquid, and a tub ring 22 may be mounted to the tub 14 at or near the upper edge 20.

A perforated basket 24 may be mounted in the tub 14 for rotation about an axis of rotation X, such as, for example, a central, vertical axis extending through the center of a laundry mover 26 in the form of an impeller, as an example, located within the basket 24. Other exemplary types of laundry movers include, but are not limited to, an agitator, a wobble plate, and a hybrid impeller/agitator. While the perforated basket 24 shown rotates about a vertical axis X, other embodiments may have a basket 24 that rotates about an axis skewed from vertical.

The basket 24 may have a generally cylindrical side or peripheral wall 28 closed at its bottom end by a base 30 to form an interior at least partially defining a laundry treating chamber 32 receiving a load of laundry items for treatment. The peripheral wall 28 may include a plurality of apertures or perforations 34 such that liquid supplied to the basket 24 may flow through the perforations 34 to the tub 14. A balance ring assembly 36 may be coupled with the basket 24 to counterbalance a load imbalance that may occur within the treating chamber 32 during a cycle of operation, as described in further detail below. The illustrated balance ring assembly 36 is provided at the top or an upper edge 38 of the basket 24; in other embodiments of the invention, the balance ring assembly 36 may be provided at the bottom or base 30 of the basket 24, or in between the bottom and top of the basket 24. The top of the cabinet 12 may include a selectively openable lid 42 to provide access into the laundry treating chamber 32 through an open top of the basket 24. While the embodiments of the invention are described in the context of a washing machine having a rotatable basket located within a tub, it will be understood that the embodiments may also be used in a washing machine which has an imperforate drum without a tub. Embodiments may have application to any system with a rotatable clothes washing container.

A drive system including a drive motor 44, which may or may not include a gear case, may be utilized to rotate the basket 24 and the laundry mover 26. The motor 44 may rotate the basket 24 at various speeds, including at a spin speed wherein a centrifugal force at the inner surface of the basket peripheral wall 28 is 1 g or greater; spin speeds are commonly known for use in extracting liquid from the laundry items in the basket 24, such as after a wash or rinse step in a treating cycle of operation. The motor 44 may also oscillate or rotate the laundry mover 26 about its axis of rotation during a cycle of operation in order to provide movement to the load contained within the laundry treating chamber 32.

A suspension system 46 may dynamically hold the tub 14 within the cabinet 12. The suspension system 46 may dissipate a determined degree of vibratory energy generated by the rotation of the basket 24 and/or the laundry mover 26 during a treating cycle of operation. Together, the tub 14, the basket 24, and any contents of the basket 24, such as liquid and laundry items, define a suspended mass for the suspension system 46.

The washing machine 10 may be fluidly connected to a liquid supply 50 through a liquid supply system including a liquid supply conduit 52 having a valve assembly 54 that may be operated to selectively deliver liquid, such as water, to the tub 14 through a liquid supply outlet 56, which is shown by example as being positioned at one side of the tub 14. The liquid supply 50 may be a household water source.

The washing machine 10 may further include a recirculation and drain system having a pump assembly 58 that may pump liquid from the tub 14 through a recirculation conduit 60 for recirculation of the liquid back into the tub 14 and/or to a drain conduit 62 to drain the liquid from the washing machine 10.

The washing machine 10 may also be provided with a dispensing system for dispensing treating chemistry to the basket 24, either directly or mixed with water from the liquid supply system, for use in treating the laundry according to a cycle of operation. The dispensing system may include a dispenser 64 which may be a single use dispenser, a bulk dispenser, or a combination of a single use and bulk dispenser. Water may be supplied to the dispenser 64 from the liquid supply conduit 52 by directing the valve assembly 54 to direct the flow of water to the dispenser 64 through a dispensing supply conduit 66. In this case, the valve assembly 54 may be a diverter valve having multiple outlets such that the diverter valve may selectively direct a flow of liquid to one or both of the liquid supply outlet 56 and the dispensing supply conduit 66.

It is noted that the illustrated drive system, suspension system, liquid supply system, recirculation and drain system, and dispensing system are shown for exemplary purposes only and are not limited to the systems shown in the drawings and described above; the particular drive system, suspension system, liquid supply system, recirculation and drain system, and dispensing system are not directly germane to the invention. For example, the liquid supply, dispensing, and recirculation and drain systems may differ from the configuration shown in FIG. 1, such as by inclusion of other valves, conduits, treating chemistry dispensers, sensors (such as water level sensors and temperature sensors), and the like, to control the flow of liquid through the washing machine 10 and for the introduction of more than one type of treating chemistry. For example, the liquid supply system and/or the dispensing system may be configured to supply liquid into the interior of the tub 14 not occupied by the basket 24 such that liquid may be supplied directly to the tub 14 without having to travel through the basket 24. In another example, the liquid supply system may include separate valves for controlling the flow of hot and cold water from the household water source. In another example, the recirculation and drain system may include two separate pumps for recirculation and draining, instead of the single pump as previously described.

The washing machine 10 may also be provided with a heating system (not shown) to heat liquid provided to the treating chamber 32. In one example, the heating system can include a heating element provided in the sump to heat liquid that collects in the sump. Alternatively, the heating system may be in the form of an in-line heater that heats the liquid as it flows through the liquid supply, dispensing and/or recirculation systems.

The washing machine 10 may further include a control system for controlling the operation of the washing machine 10 to implement one or more treating cycles of operation. The control system may include a controller 70 located within a console 72 on top of the cabinet 12, or elsewhere, such as within the cabinet 12, and a user interface 74 that is operably coupled with the controller 70. The user interface 74 may include one or more knobs, dials, switches, displays, touch screens and the like for communicating with the user, such as to receive input and provide output. The user may enter different types of information including, without limitation, cycle selection and cycle parameters, such as cycle options.

The controller 70 may include the machine controller and any additional controllers provided for controlling any of the components of the washing machine 10. For example, the controller 70 may include the machine controller and a motor controller. Many known types of controllers may be used for the controller 70. The specific type of controller is not germane to the invention. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), may be used to control the various components of the washing machine 10.

Figure 2:
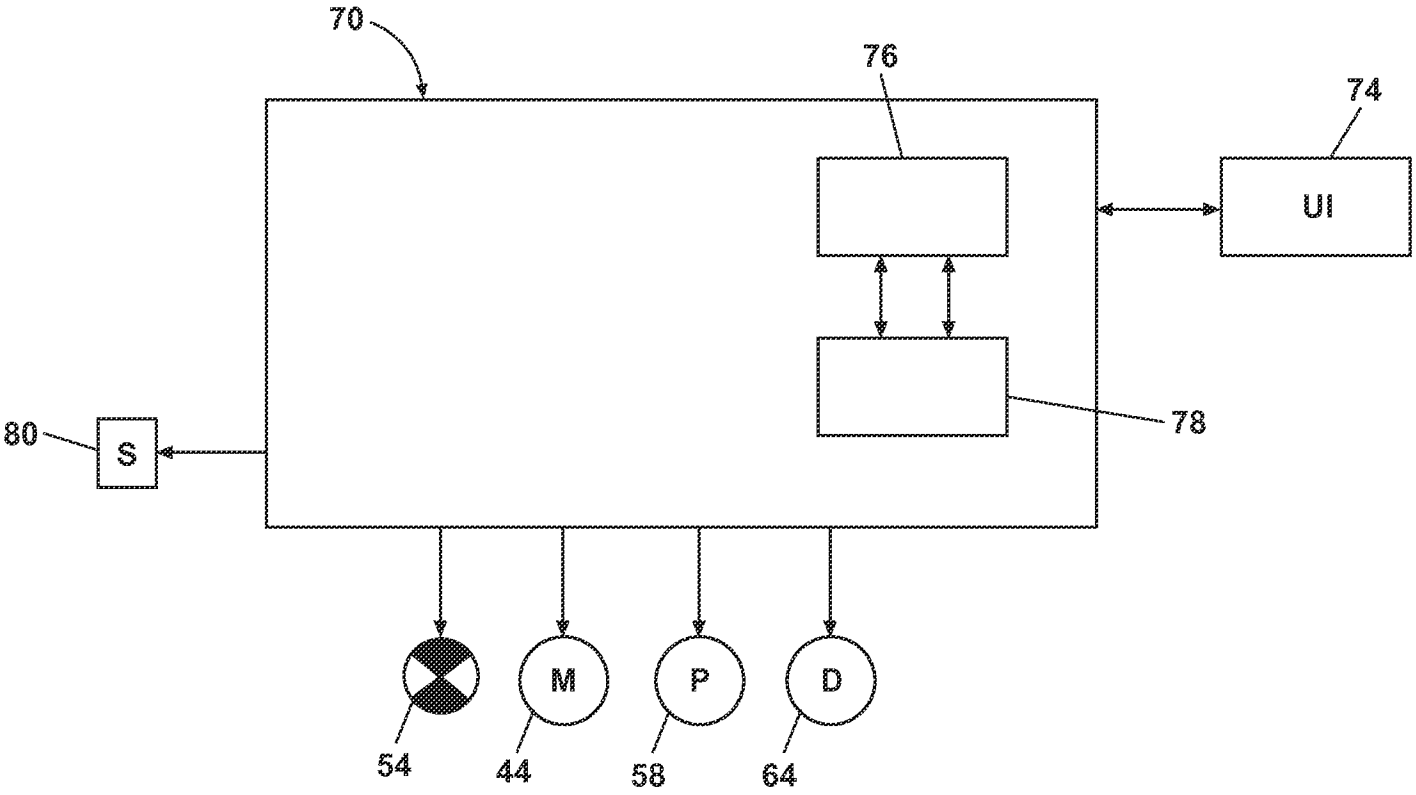
FIG. 2 is a schematic view of a control system of the laundry treating appliance of FIG. 1.

FIG. 2 is a schematic view of the control system of the washing machine 10. The controller 70 may be provided with a memory 76 and a central processing unit (CPU) 78. The memory 76 may be used for storing the control software that is executed by the CPU 78 in completing a treating cycle of operation using the washing machine 10 and any additional software. Examples, without limitation, of treating cycles of operation include: wash, heavy duty wash, delicate wash, quick wash, pre-wash, refresh, rinse only, and timed wash. The memory 76 may also be used to store information, such as a database or table, and to store data received from one or more components of the washing machine 10 that may be communicably coupled with the controller 70. The database or table may be used to store the various operating parameters for the one or more cycles of operation, including factory default values for the operating parameters and any adjustments to them by the control system or by user input.

The controller 70 may be operably coupled with one or more components of the washing machine 10 for communicating with and controlling the operation of the component to complete a cycle of operation. For example, the controller 70 may be operably coupled with the motor 44, the valve assembly 54, the pump assembly 58, the dispenser 64, and any other additional components that may be present such as a steam generator and/or a sump heater (not shown) to control the operation of these and other components to implement one or more of the cycles of operation. The controller 70 may also be coupled with one or more sensors 80 provided in one or more of the systems of the washing machine 10 to receive input from the sensors, which are known in the art and not shown for simplicity.

The basket 24, tub 14, laundry mover 26, motor 44 and any liquid or laundry in the treating chamber 32 and tub 14 may be thought of as a mass that is suspended from the cabinet 12 by the suspension system 46. The suspension system 46 has various dynamic modes that may change depending on the rotational speed of the basket 24, especially when laundry within the treating chamber 32 is non-uniformly distributed relative to the rotational axis X and forms an imbalance.

During operation of the washing machine 10, when a load imbalance occurs, the imbalance may induce the basket 24 to deviate off its anticipated rotational path and move in a side-to-side direction, which may be referred to as a pendulum mode because the suspended mass is essentially swinging back and forth on the suspension system 46 within the cabinet 12. Such back and forth swinging may result in washing machine 10 "walking" across the surface on which it rests, and/or the basket 24 may collide with the tub 14 and/or cabinet 12, which is noisy and may cause wear or damage to the machine 10 if left unchecked. A vertical travel mode is another dynamic mode that occurs when the suspended mass starts reciprocating up and down due to a load imbalance, which in severe cases may cause part of the basket 24 or tub 14 to contact the cabinet 12, causing related movement of the washing machine 10.

The rotational speed of the basket 24 at which the pendulum mode and vertical travel mode is present is typically a function of the structure of the specific appliance. For the illustrated washing machine 10, the pendulum mode occurs between 50-90 rpm as the basket 24 transitions to speeds where the laundry tends to "satellize" within the basket 24. That is, the centrifugal force applied to the laundry is sufficient for the laundry to "stick" to the basket 24 and not move. The pendulum mode tends to correspond to the first natural frequency of the suspended mass. Also for the illustrated washing machine 10, the vertical travel mode occurs around 170-240 rpm. The vertical travel mode tends to correspond to the second natural frequency of the suspended mass. If one of these modes becomes significant during a cycle of operation, a user may need to stop the cycle to redistribute or remove part of the load in the basket 24.

Traditional fluid-filled balance ring assemblies can mitigate the effects of load imbalance during a steady state, high speed spin, but may add to or exacerbate the imbalance during lower speed spins or during ramp up to higher speed spins. The speed at which a traditional balance ring assembly may effectively mitigate the effects of load imbalance may be referred herein to as a critical speed. Below the critical speed, traditional fluid-filled balance ring assemblies have been found to add to or exacerbate the imbalance.

With respect to the pendulum mode and vertical travel mode discussed above, as the pendulum mode tends to correspond to the first natural frequency of the suspended mass and occurs at lower spin speeds, a traditional fluid-filled balance ring assembly may not adequately address imbalances that induce the pendulum mode.

Embodiments of the present invention provide a balance ring assembly that does not add to or exacerbate the imbalance during the pendulum mode. The balance ring assembly 36 may further be configured to correct other types of imbalances as well.

The various embodiment(s) of the laundry treating appliance described herein provide a balance ring assembly that can counterbalance a load imbalance that may occur within the treating chamber during a cycle of operation. One advantage that may be realized in the practice of some embodiments of the described laundry treating appliance is that the balance ring assembly does not contribute to imbalances at lower rotational speeds that traditional fluid-filled balance ring assemblies would add to or exacerbate. The use of two balance rings configured to collect balancing fluid on opposing sides of the basket at low RPMs can cancel their respective contributions to any imbalance.

Figure 3:
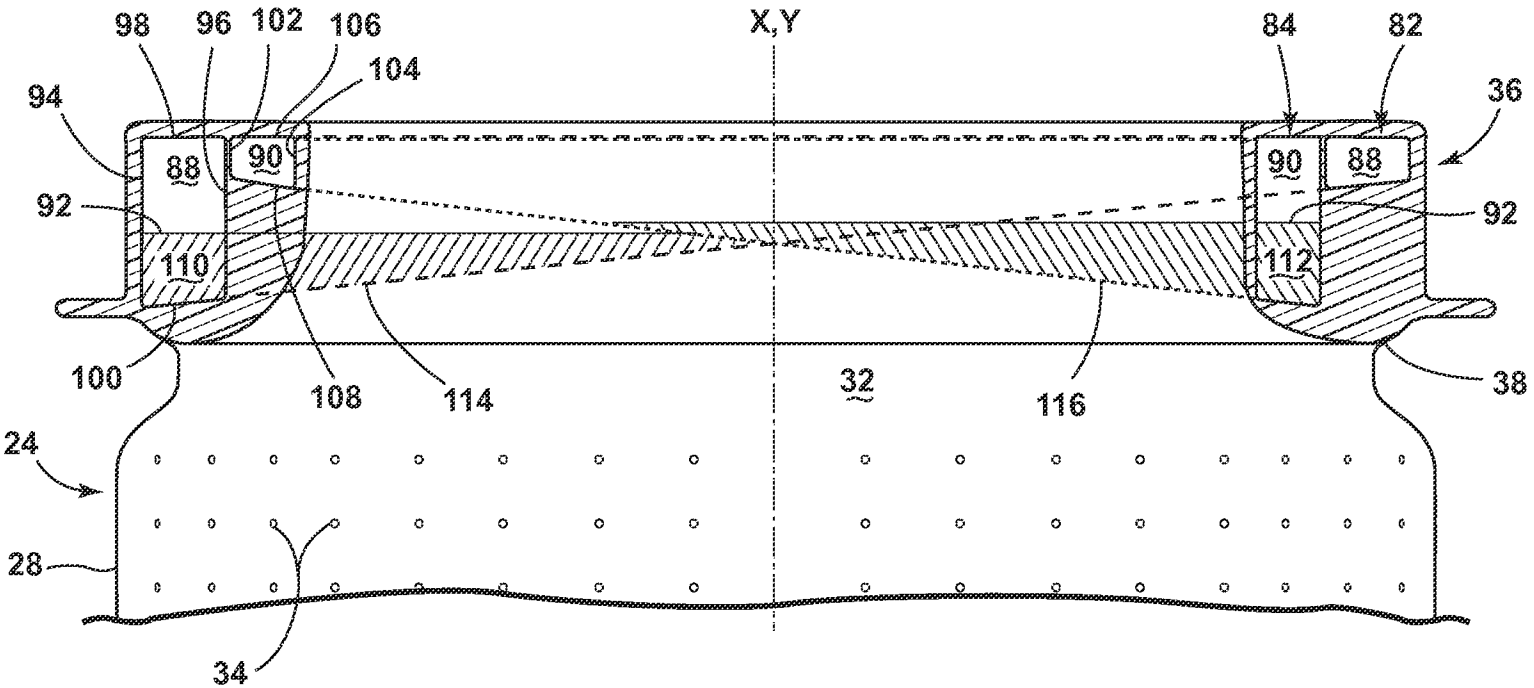
FIG. 3 is a sectional view of a balance ring assembly for the washing machine of FIG. 1.

FIG. 3 is a sectional view of the balance ring assembly 36 for the washing machine 10 of FIG. 1 according to a first embodiment of the invention. The balance ring assembly 36 includes a first annular balance ring 82 and a second annular balance ring 84. The balance rings 82, 84 may be coupled with the upper edge 38 of the basket peripheral wall 28 for rotation with the basket 24 during operation. The balance rings 82, 84 may be disposed on a common ring axis Y that may further be coincident with the axis of rotation X of the basket 24. In other embodiments of the invention, the balance rings 82, 84 may be provided at the bottom or base 30 of the basket 24, or in between the bottom and top of the basket 24 (see FIG. 1). The balance rings 82, 84 may be separate rings, or formed together as shown in the illustrated embodiment.

Each balance ring 82, 84 defines a hollow, annular chamber 88, 90, respectively and includes a balancing fluid 92 which may partly fill the chamber 88, 90. The balancing fluid 92 may comprise water, or another type of balancing fluid, some non-limiting examples of which include a saline solution or oil.

The first balance ring 82 includes an outer peripheral wall 94 and an inner peripheral wall 96 that are joined by a top wall 98 and a bottom wall 100. The walls 94, 96, 98, 100 can collectively define the first annular chamber 88.

The second balance ring 84 includes an outer peripheral wall 102 and an inner peripheral wall 104 that are joined by a top wall 106 and a bottom wall 108. The walls 102, 104, 106, 108 can collectively define the second annular chamber 90.

In the illustrated embodiment, the balance rings 82, 84 are concentric, with the second balance ring 84 being received within the first balance ring 84. Thus, the radius defined by the outer peripheral wall 102 of the second balance ring 84 may be substantially equal to or slightly smaller than the radius defined by the inner peripheral wall 96 of the first balance ring 82. Further, at least a portion of the outer peripheral wall 102 of the second balance ring 84 and the inner peripheral wall 96 of the first balance ring 82 may be a shared or common wall. The peripheral walls 94, 96, 102, 104 may be generally parallel to the axes X, Y, with the top walls 98, 106 extending transversely to the peripheral walls 94, 96, 102, 104. Also, the top walls 98, 106 of the balance rings 82, 84 may be a shared or common wall.

Figure 4:
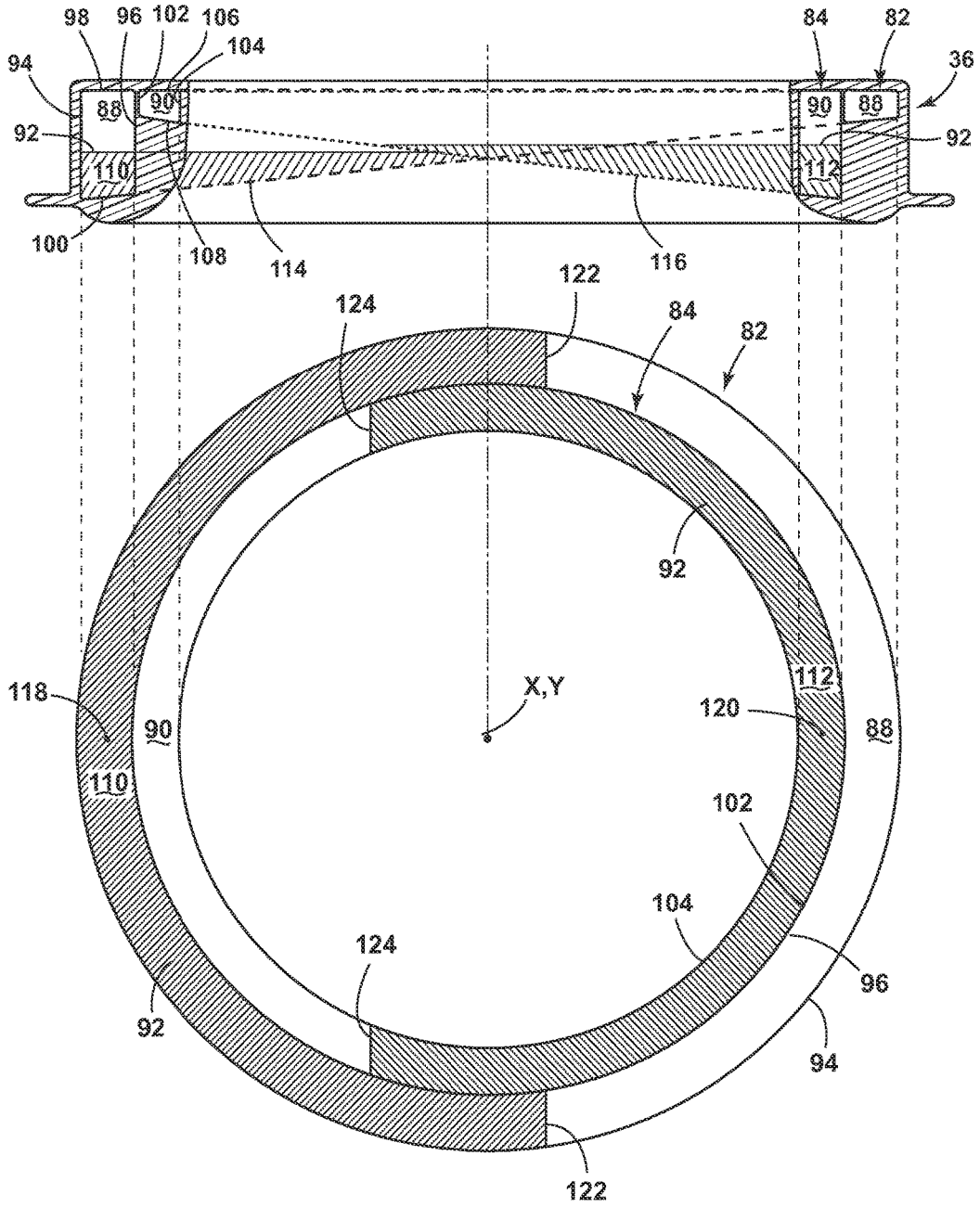
FIG. 4 is an aligned side and top view of the balance ring assembly from FIG. 3.

FIG. 4 is an aligned side and top view of the balance ring assembly 36 from FIG. 3. Each balance ring 82, 84 further defines a sump 110, 112, respectively in the hollow, annular chamber 88, 90. The sump 110 of the first balance ring 82 is disposed opposite the sump 112 of the second balance ring 84, i.e. on opposing sides of the ring axis Y. The sumps 110, 112 are configured to collect the balancing fluid 92 when the rotation speed of the basket 24 is below a predetermined critical speed, as described in further detail below.

In the illustrated embodiment, each sump 110, 112 is defined by an inclined or sloped portion 114, 116 of the bottom wall 100, 108, respectively. The sloped portions 114, 116 may be approximately 2-10 degrees from a horizontal plane. Angles smaller than 2 degrees may not accommodate for installation conditions that are out-of-level, and angles larger than 10 degrees may be used, but may not be optimal since as the angle increases, the height of the balance ring must increase. The entire bottom wall 100, 108 of the balance rings 82, 84 may be sloped, with the lowermost portion of the sloped bottom wall 100, 108 defining the sump 110, 112. As illustrated, the entire bottom walls 100, 108 are inclined, but it is contemplated that alternatively only a portion of the bottom wall 100, 108 is inclined relative to the horizontal. For example, one or both of the bottom walls 100, 108 may include a planar portion and a sloped portion which defines the sump. In such an example, the sloped portion may be configured to receive the entire volume of balancing fluid 92 within the balance ring 82, 84 when the rotation speed of the basket 24 is a below the predetermined critical speed, such that little or no balancing fluid 92 is held by the planar portion.

Here, the sumps 110, 112 span a partial circumference of the balance rings 82, 84. A lowermost portion of the bottom wall 100, 108 defines a middle or center 118, 120 of each sump 110, 112, with the centers 118, 120 being diametrically opposite each other. Each sump 110, 112 can extend equidistantly from the center 118, 120 to outer ends 122, 124, respectively. The center 118, 120 of each sump 110, 112 can define the deepest point of the sump 110, 112, while the outer ends 122, 124 can define the shallowest point of the sump 110, 112.

As shown, the sumps 110, 112 may overlap about the ring axis Y. Here, the outer ends 122, 124 of the sumps 110, 112 overlap each other about the ring axis Y. In other embodiments, the sumps 110, 112 may not overlap.

FIGS. 3-4 depict a condition in which the rotational speed of the basket 24 is below the critical speed. In this condition, the balancing fluid 92 tends to pool in the sumps 110, 112. The degree to which the balancing fluid 92 pools is based on the rotational speed of the basket 24, and will decrease as rotational speed increases. Even at speeds below the critical speed, some balancing fluid 92 may move out of the sumps 110, 112. For example, at or below 50 RPM, centrifugal force is low enough that most or all of the balancing fluid 92 is pooled in the sumps 110, 112 due to gravitational force on the fluid 92. Above 50 RPM and with increasing speeds, more and more balancing fluid 92 will be pulled out of the sumps 110, 112 by centrifugal force. However, below the critical speed, the bulk of the balancing fluid 92 remains in the sumps 110, 112.

In a condition in which the rotational speed of the basket 24 is at or above the critical speed, the balancing fluid 92 moves toward the outer circumference of the balance rings 82, 84 under the centrifugal force of the rotating basket 24. For example, the volume of balancing fluid 92 may lie over the outer peripheral walls 94, 102 of the balance rings 82, 84. The critical speed can be a range of speeds tuned with the pendulum mode of the washing machine. In one example, the critical speed can be between 70-120 RPM, depending on mass, geometry, and suspension characteristics of the system. Above the critical speed, such as above 120 RPM, centrifugal forces dominate, and the bulk of the balancing fluid 92 will be forced outwardly against the outer peripheral walls 94, 102 of the balance rings 82, 84.

During balanced conditions below the critical speed, the balancing fluid 92 generally spreads evenly about the balance rings 82, 84 within the sumps 110, 112. Imbalances are not corrected by the balance rings 82, 84 below the critical speed. Rather, the balancing fluid 92 is still held within the sumps 110, 112 below the critical speed, regardless of where the imbalance occurs. If the balancing fluid 92 were allowed to move freely below the critical speed, the balancing fluid 92 would tend to move in phase with the imbalance, exacerbating the imbalance. Below the critical speed, imbalances typically result in the pendulum mode with traditional fluid-filled balance ring assemblies; with the balance ring assembly 36 shown herein, the pendulum mode may be avoided below the critical speed.

During balanced conditions at or above the critical speed, the balancing fluid 92 generally spreads evenly about the balance rings 82, 84. During an imbalance condition at or above the critical speed, the bulk of the balancing fluid 92 may move opposite the load to correct the imbalance. At or above the critical speed, imbalances typically result in the vertical travel mode if not corrected.

Figure 5:
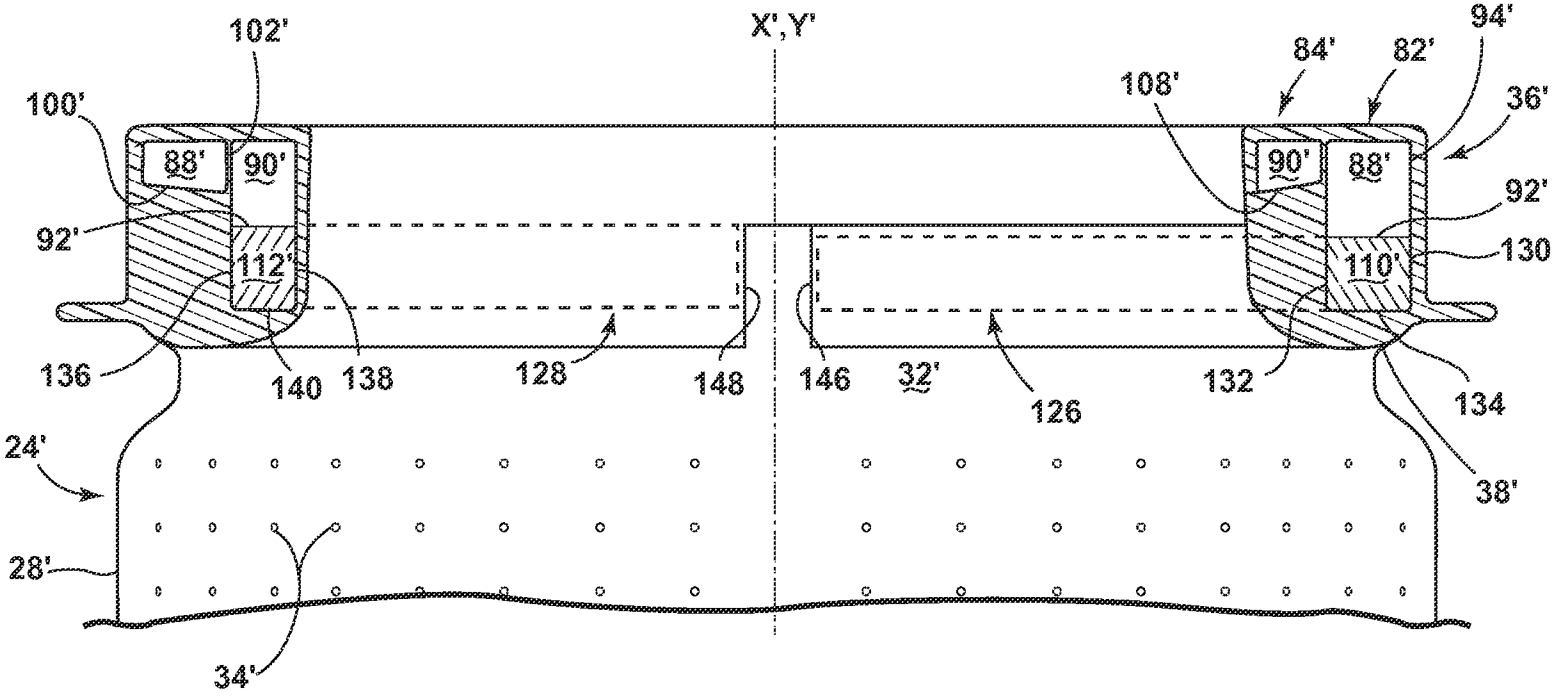
FIG. 5 is a sectional view of a balance ring assembly for the washing machine of FIG. 1 according to a second embodiment of the invention.

FIG. 5 is a sectional view of a balance ring assembly 36' for the washing machine 10 of FIG. 1 according to a second embodiment of the invention. The balance ring assembly 36' may be similar in some respects to the first embodiment, and like elements are referred to with the same reference numerals bearing a prime (') symbol. The balance ring assembly 36' differs from the first embodiment in the configuration of the sumps 110', 112' for the balance rings 82', 84'. In the second embodiment, each sump 110', 112' is defined by a pit 126, 128 in the bottom wall 100', 108', respectively. The bottom walls 100', 108' may be planar as shown, or may be sloped toward their respective pit 126, 128.

The first pit 126 includes an outer wall 130 and an inner wall 132 that are joined by a bottom wall 134. The walls 130, 132, 134 can collectively define the sump 110'. The top of the pit 126 is open to the annular chamber 88'. The open top defines an inlet and an outlet for the sump 110'. At least a portion of the outer peripheral wall 94' of the first balance ring 82' and the outer wall 130 of the first pit 126 may be a shared or common wall.

The second pit 128 includes an outer wall 136 and an inner wall 138 that are joined by a bottom wall 140. The walls 136, 138, 140 can collectively define the sump 112'. The top of the pit 128 is open to the annular chamber 90'. The open top defines an inlet and an outlet for the sump 112'. At least a portion of the outer peripheral wall 102' of the second balance ring 84' and the outer wall 136 of the second pit 128 may be a shared or common wall.

The pits 126, 128 may be dimensioned with respect to the volume of balancing fluid 92'. In such an example, the pits 126, 128 may be configured to receive the entire volume of balancing fluid 92' when the rotation speed of the basket 24 is a below the predetermined critical speed.

Figure 6:
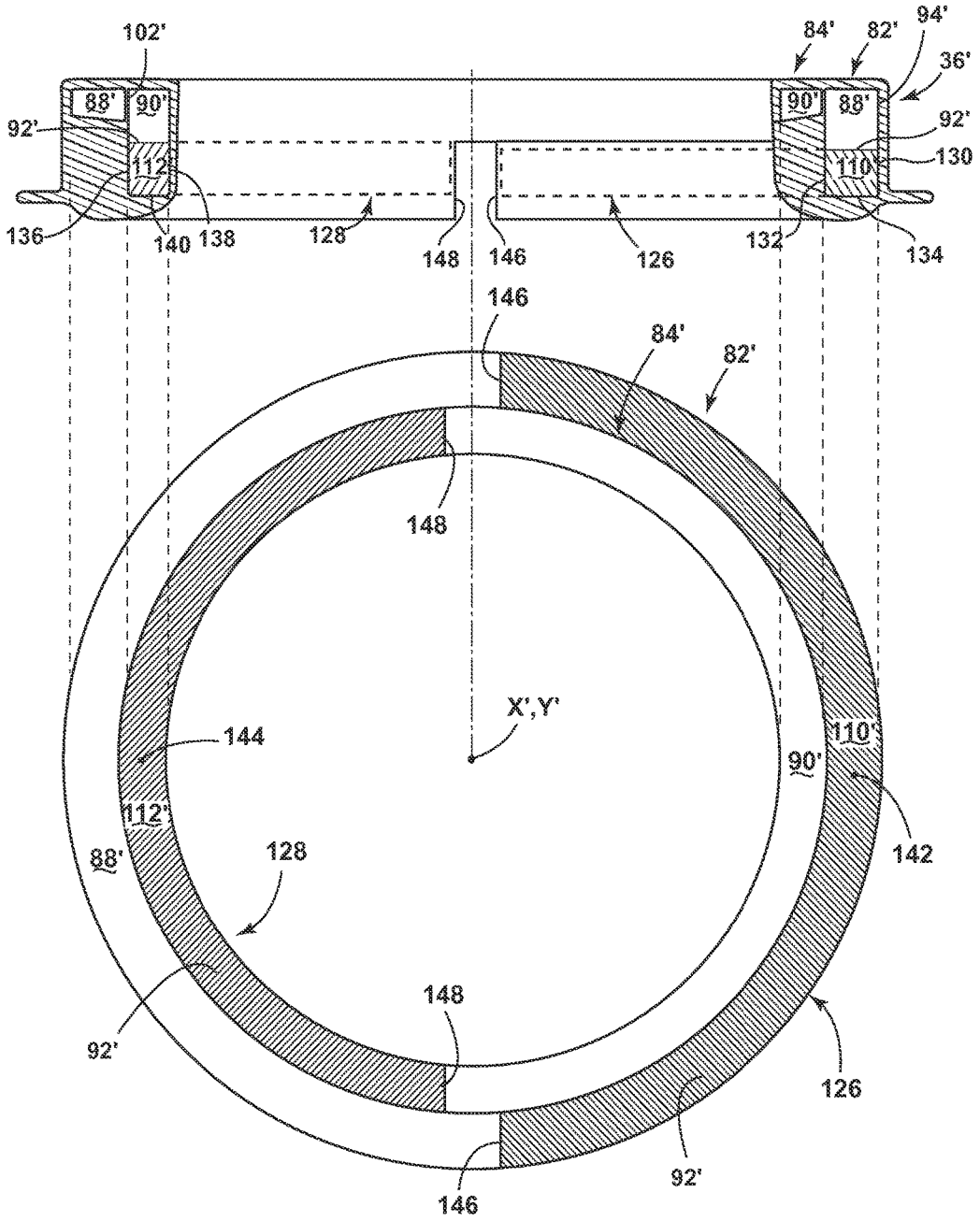
FIG. 6 is an aligned side and top view of the balance ring assembly from FIG. 5.

FIG. 6 is an aligned side and top view of the balance ring assembly 36' from FIG. 5. The pits 126, 128 span a partial circumference of the balance rings 82', 84', and are shown as filled with balancing fluid 92'. Each sump 110', 112' can extend equidistantly from a center 142, 144 to outer end walls 146, 148, respectively. In the illustrated embodiment, the centers 142, 144 of the pits 126, 128 are diametrically opposite each other and the sumps 110', 112' do not overlap about the ring axis Y', and the outer end walls 146, 148 of the sumps 110', 112' are horizontally spaced from each other, relative to the ring axis Y'. In other embodiments, the pits 126, 128 may be configured such that the outer end walls 146, 148 are aligned, or the pits 126, 128 can be configured to overlap each other.

The bottom wall 134, 140 of each pit 126, 128 can be planar, such that the depth of the sump 110', 112' is constant between the end walls 146, 148. Alternatively, the bottom wall 134, 140 of each pit 126, 128 can be sloped or inclined, such that the depth of each sump 110', 112' changes at least once between the end walls 146, 148.

FIGS. 5-6 depict a condition in which the rotational speed of the basket 24' is below the critical speed. In this condition, the balancing fluid 92' tends to pool in the pits 126, 128. The degree to which the balancing fluid 92' pools is based on the rotational speed of the basket 24', and will decrease as rotational speed increases. Even at speeds below the critical speed, some balancing fluid 92' may move out of the pits 126, 128. For example, at or below 50 RPM, centrifugal force is low enough that most or all of the balancing fluid 92' is pooled in the pits 126, 128 due to gravitational force on the fluid 92'. Above 50 RPM and with increasing speeds, more and more balancing fluid 92' will be pulled out of the pits 126, 128 by centrifugal force. However, below the critical speed, the bulk of the balancing fluid 92' remains in the pits 126, 128.

In a condition in which the rotational speed of the basket 24' is at or above the critical speed, the balancing fluid 92' moves toward the outer circumference of the balance rings 82', 84' under the centrifugal force of the rotating basket 24'. For example, the volume of balancing fluid 92' may lie over the outer walls 130, 136 of the pits 126, 128 as well as the outer walls 94', 102' balance rings 82', 84'. The critical speed can be a range of speeds tuned with the pendulum mode of the washing machine. In one example, the critical speed can be between 70-120 RPM, depending on mass, geometry, and suspension characteristics of the system. Above the critical speed, such as above 120 RPM, centrifugal forces dominate, and the bulk of the balancing fluid 92' will be forced outwardly against the outer peripheral walls 94', 102' of the balance rings 82', 84'.

During balanced conditions below the critical speed, the balancing fluid 92' generally spreads evenly about the balance rings 82', 84' within the pits 126, 128. Imbalances are not corrected by the balance rings 82', 84' below the critical speed. Rather, the balancing fluid 92' is still held within the pits 126, 128 below the critical speed, regardless of where the imbalance occurs. If the balancing fluid 92' were allowed to move freely below the critical speed, the balancing fluid 92' would tend to move in phase with the imbalance, exacerbating the imbalance. Below the critical speed, imbalances typically result in the pendulum mode with traditional fluid-filled balance ring assemblies; with the balance ring assembly 36' shown herein, the pendulum mode may be avoided below the critical speed.

During balanced conditions at or above the critical speed, the balancing fluid 92' generally spreads evenly about the balance rings 82', 84'. During an imbalance condition at or above the critical speed, the bulk of the balancing fluid 92' may move opposite the load to correct the imbalance. At or above the critical speed, imbalances typically result in the vertical travel mode if not corrected.

Figure 7:
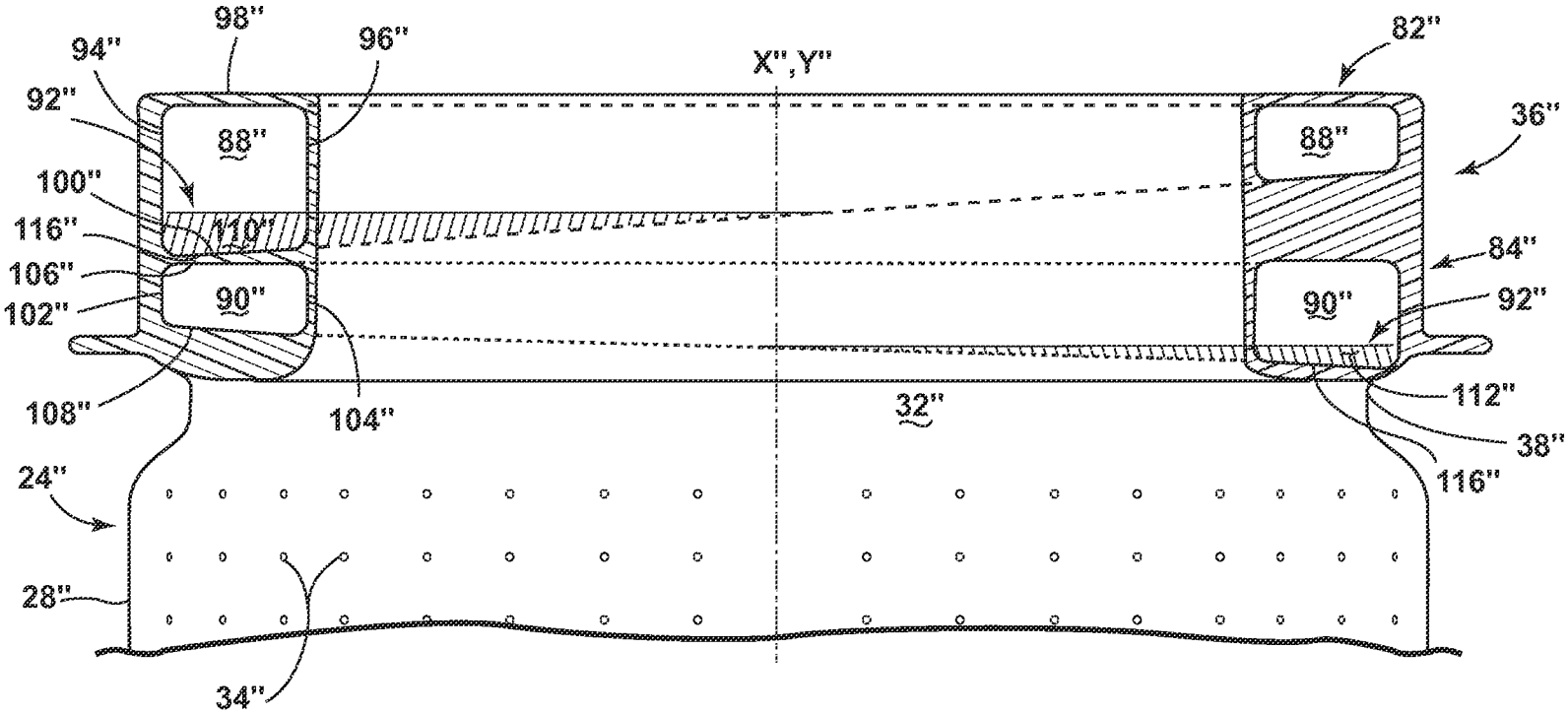
FIG. 7 is a sectional view of a balance ring assembly for the washing machine of FIG. 1 according to a third embodiment of the invention.

FIG. 7 is a sectional view of a balance ring assembly 36" for the washing machine 10 of FIG. 1 according to a third embodiment of the invention. The balance ring assembly 36" may be similar in some respects to the first embodiment, and like elements are referred to with the same reference numerals bearing a double prime (") symbol. The balance ring assembly 36" differs from the first embodiment in the configuration of the balance rings 82", 84". In the third embodiment, the balance rings 82", 84" are stacked, with the first balance ring 82" positioned above the second balance ring 84". The radius of the balance rings 82", 84" may be substantially equal to each other. As illustrated, the outer peripheral walls 94", 102" and the inner peripheral walls 96", 104" of the balance rings 82", 84" may a shared or common wall. The balance rings 82", 84" may be separate rings, or formed together as shown in the illustrated embodiment.

Due to the stacked arrangement of the balance rings 82", 84", the first sump 110" may be higher relative to the peripheral wall 28" of the basket 24" than the second sump 112". As shown, the sumps 110", 112" do not overlap in the direction along the ring axis Y", but may overlap about the ring axis Y" as shown in FIG. 4 for the first embodiment. For purposes of illustration, the sumps 110", 112" are substantially similar to the sumps 110, 112 of the first embodiment shown in FIGS. 3-4. Alternatively, the sumps 110", 112" may be formed by pits, similarly to the pits 126, 128 of the second embodiment shown in FIGS. 5-6.

FIG. 7 depicts a condition in which the rotational speed of the basket 24" is below the critical speed. In this condition, the balancing fluid 92" tends to pool in the sumps 110", 112". The degree to which the balancing fluid 92" pools is based on the rotational speed of the basket 24", and will decrease as rotational speed increases. Even at speeds below the critical speed, some balancing fluid 92" may move out of the sumps 110", 112". For example, at or below 50 RPM, centrifugal force is low enough that most or all of the balancing fluid 92" is pooled in the sumps 110", 112" due to gravitational force on the fluid 92". Above 50 RPM and with increasing speeds, more and more balancing fluid 92" will be pulled out of the sumps 110", 112" by centrifugal force. However, below the critical speed, the bulk of the balancing fluid 92" remains in the sumps 110", 112".

In a condition in which the rotational speed of the basket 24" is at or above the critical speed, the balancing fluid 92" moves toward the outer circumference of the balance rings 82", 84" under the centrifugal force of the rotating basket 24". For example, the volume of balancing fluid 92" may lie over the outer peripheral walls 94", 102" of the balance rings 82", 84". The critical speed can be a range of speeds tuned with the pendulum mode of the washing machine. In one example, the critical speed can be between 70-120 RPM, depending on mass, geometry, and suspension characteristics of the system. Above the critical speed, such as above 120 RPM, centrifugal forces dominate, and the bulk of the balancing fluid 92" will be forced outwardly against the outer peripheral walls 94", 102" of the balance rings 82", 84".

During balanced conditions below the critical speed, the balancing fluid 92" generally spreads evenly about the balance rings 82", 84" within the sumps 110", 112". Imbalances are not corrected by the balance rings 82", 84" below the critical speed. Rather, the balancing fluid 92" is still held within the sumps 110", 112" below the critical speed, regardless of where the imbalance occurs. If the balancing fluid 92" were allowed to move freely below the critical speed, the balancing fluid 92" would tend to move in phase with the imbalance, exacerbating the imbalance. Below the critical speed, imbalances typically result in the pendulum mode with traditional fluid-filled balance ring assemblies; with the balance ring assembly 36" shown herein, the pendulum mode may be avoided below the critical speed.

During balanced conditions at or above the critical speed, the balancing fluid 92" generally spreads evenly about the balance rings 82", 84". During an imbalance condition at or above the critical speed, the bulk of the balancing fluid 92" may move opposite the load to correct the imbalance. At or above the critical speed, imbalances typically result in the vertical travel mode if not corrected.

In any of the above embodiments, baffles may be included in the annular chambers to reduce the splashing and sloshing of the balancing fluid in the balancing rings. The baffles may extend from one or more of the walls defining the annular chambers. To the extent not already described, the different features and structures of the various embodiments of the balance ring assemblies 36, 36', 36" may be used in combination with each other as desired. That one feature may not be illustrated in all of the embodiments of the balance ring assemblies 36, 36', 36" is not meant to be construed that it cannot be, but is done for brevity of description. Thus, the various features of the different embodiments of the balance ring assemblies 36, 36', 36" may be mixed and matched as desired to form new embodiments, whether or not the new embodiments are expressly described.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry treating appliance for treating laundry according to a cycle of operation, comprising:

a rotatable basket configured to rotate about an axis of rotation and defining a treating chamber receiving a load of laundry items for treatment;

a first annular balance ring operably coupled with the rotatable basket for rotation therewith and having a first hollow annular chamber with a first sump formed by a first pit having a first top open to a remainder of the first hollow annular chamber and a fluid partly filling the first hollow annular chamber; and a second annular balance ring located within the first balance ring and operably coupled with the rotatable basket for rotation therewith and having a second hollow annular chamber with a second sump formed by a second pit having a second top open to a remainder of the second hollow annular chamber and a fluid partly filling the second hollow annular chamber wherein the second hollow annular chamber is fluidly separate from the first hollow annular chamber;

wherein the first sump is diametrically opposite from the second sump about the axis of rotation and wherein the first hollow annular chamber with the first sump and the second hollow annular chamber with the second sump are configured to pool the fluid in the first sump and the second sump when a rotational speed of the rotatable basket is below a critical speed.

2. The laundry treating appliance according to claim 1 wherein the first sump of the first annular balance ring does not circumferentially overlap the second sump of the second annular balance ring.

3. The laundry treating appliance according to claim 1 wherein a bottom wall of each pit is sloped resulting in a depth of each of the first sump and the second sump to change at least once between end walls thereof.

4. The laundry treating appliance according to claim 1 wherein the first sump at least partially overlaps the second sump about the axis of rotation.

5. The laundry treating appliance according to claim 1 wherein the first sump at least partially overlaps the second sump about the axis of rotation.

6. A laundry treating appliance for treating laundry according to a cycle of operation, comprising:

a rotatable basket configured to rotate about an axis of rotation and defining a treating chamber receiving a load of laundry items for treatment;

a first annular balance ring operably coupled with the rotatable basket for rotation therewith and having a first hollow annular chamber with a first sump in the first hollow annular chamber and a fluid partly filling the first hollow annular chamber; and a second annular balance ring located radially within the first annular balance ring and operably coupled with the rotatable basket for rotation therewith and having a second hollow annular chamber with a second sump in the second hollow annular chamber and a fluid partly filling the second hollow annular chamber;

wherein the first hollow annular chamber is fluidly separate from the second hollow annular chamber, the first sump and the second sump are disposed on opposing sides of the axis of rotation and configured such that the fluids will pool in the first sump and the second sump when a rotational speed of the rotatable basket is below a critical speed regardless of a presence of an imbalance of the load of laundry items.

7. The laundry treating appliance according to claim 6 wherein during balanced conditions at or above the critical speed, the first annular balance ring and the second annular balance ring are configured so that fluid spreads evenly about the first annular balance ring and the second annular balance ring and during an imbalance condition at or above the critical speed, a bulk of the fluid moves opposite the load of laundry items to correct the imbalance.

8. The laundry treating appliance according to claim 6 wherein the first annular balance ring and second annular balance ring are formed together within a singular body.

9. The laundry treating appliance according to claim 6 wherein each sump includes a bottom wall that extends equidistantly from a center to outer ends, with the center defining the deepest point of the sump and the outer ends defining the shallowest point of the sump.

10. The laundry treating appliance according to claim 6 wherein each of the first and second sumps comprises a sloped bottom wall partly defining the hollow annular chamber wherein a slope of the sloped bottom wall is within a range of two degrees from a horizontal plane to ten degrees from a horizontal plane.

11. The laundry treating appliance according to claim 6 wherein each hollow annular chamber comprises a bottom wall, and each of the first and second sumps comprises a pit in the bottom wall.

12. The laundry treating appliance according to claim 6 wherein the first sump does not overlap the second sump about the axis of rotation.

13. A laundry treating appliance for treating laundry according to a cycle of operation, comprising:

a rotatable basket configured to rotate about an axis of rotation and defining a treating chamber receiving a load of laundry items for treatment; and two annular balance rings operably coupled with the rotatable basket for rotation therewith;

each balance ring having a hollow annular chamber with a sump, to define a first hollow annular chamber with a first sump and a second hollow annular chamber with a second sump, the first hollow annular chamber fluidly separate from the second hollow annular chamber and a fluid partly filling both the first hollow annular chamber and the second hollow annular chamber;

wherein the two annular balance rings are concentric and a first of the two annular balance rings is radially inset in a second of the two annular balance rings, and the first and second sumps are disposed on opposing sides of the axis of rotation from each other, wherein the first hollow annular chamber with the first sump and the second hollow annular chamber with the second sump are configured to pool the fluid in the first sump and the second sump when a rotational speed of the rotatable basket is below a predetermined critical speed and wherein the first sump and the second sump are configured to receive an entire volume of the fluid within each balance ring, respectively, when the rotation speed is below the predetermined critical speed.

14. The laundry treating appliance according to claim 13 wherein the critical speed is 70 to 120 RPM.

15. The laundry treating appliance according to claim 13 wherein each of the first and second sumps comprises a sloped bottom wall partly defining the hollow annular chamber.

16. The laundry treating appliance according to claim 13 wherein each hollow annular chamber comprises a bottom wall, and each of the first and second sumps comprises a pit in the bottom wall.

17. The laundry treating appliance according to claim 13 wherein the first sump at least partially overlaps the second sump concentrically about the axis of rotation.

18. The laundry treating appliance according to claim 13 wherein the first sump does not overlap the second sump concentrically about the axis of rotation.

* * * * *